US005967342A

United States Patent [19]

Steffine

[11] Patent Number: 5,967,342

[45] Date of Patent: Oct. 19, 1999

[54] MULTIPURPOSE LAUNDRY CART

[76] Inventor: Christian Lee Steffine, 1001 Washington St. Apt. 206, Aliquippa, Pa. 15001

[21] Appl. No.: 09/124,342

[22] Filed: Jul. 29, 1998

Related U.S. Application Data

[60] Provisional application No. 60/055,679, Aug. 18, 1997.

[51] Int. Cl.[6] ..... A47F 7/02

[52] U.S. Cl. ..... 211/85.24; 211/85.15; D32/36; D32/37

[58] Field of Search ..... 211/85.24, 12, 211/85.15, 10, 189, 168, 96, 204; D32/36, 37; 24/DIG. 29; 209/937; 232/1 B; 294/23.5; 414/13

[56] References Cited

U.S. PATENT DOCUMENTS

| | | | |
|---|---|---|---|
| D. 124,329 | 12/1940 | Parker . | |
| D. 213,131 | 1/1969 | Hamilton | D32/37 |
| 436,839 | 9/1890 | McClure . | |
| 572,391 | 12/1896 | Whitford . | |
| 1,178,392 | 4/1916 | Foreman . | |
| 2,095,384 | 10/1937 | Gleitsman | 211/168 X |
| 2,625,973 | 1/1953 | Weldon et al. . | |
| 2,637,918 | 5/1953 | Mayhew . | |
| 4,917,249 | 4/1990 | King | 211/204 X |
| 5,294,009 | 3/1994 | Maurer et al. . | |

*Primary Examiner*—Daniel P. Stodola
*Assistant Examiner*—Erica B. Harris
*Attorney, Agent, or Firm*—Carothers & Carothers

[57] ABSTRACT

A light weight easily constructed multipurpose laundry cart which is constructed of tubular plastic and provides a frame which supports laundry bags therein and further provides a drop leaf ironing board and a drop leaf folding table hinged to the frame top for mobility with the frame. A horizontal hanging bar is also provided which is pivotally supported to the top of the laundry cart frame so that it may be folded in a horizontal plane against the frame for mobility with the frame. The drop leaf ironing board and laundry folding table may also be folded downwardly against the frame for mobility of the entire cart assembly and for easy storage.

5 Claims, 2 Drawing Sheets

MULTIPURPOSE LAUNDRY CART

CROSS REFERENCE

This application is based on U.S. Provisional Application Ser. No. 60/055,679, filed on Aug. 18, 1997, for HANDY DANDY CLOTHES CADDY.

BACKGROUND OF THE INVENTION

The field of invention relates to a cart structure, and more particularly pertains to a new and improved multipurpose laundry cart which is arranged for the support and transport of various laundry stations.

Many laundry cart apparatus of various types have been utilized in the prior art. However, they fail to provide the necessary multiple laundry work stations, ease of assembly, storage and mobility. It is an object of the present invention to provide a multipurpose laundry cart which fulfills these needs.

SUMMARY OF THE INVENTION

The multipurpose laundry cart of the present invention includes a three dimensional frame having a top that provides an open mouth and a bottom with caster wheels for mobility of the frame. At least one laundry bag, and usually three bags, are suspended in the frame.

A drop leaf ironing board is hinged to this frame for mobility with the frame. Additionally a horizontal hanging bar is also supported at one of its ends by a vertical leg from the floor and at the other end it is pivotally connected to the frame. This permits this horizontal clothes hanging bar to be pivotally folded in a horizontal plane against the frame for mobility with the frame when not in use.

An additional add-on feature of the multipurpose laundry cart of the present invention is that a drop leaf laundry folding table may also be hinged to the same frame for mobility with the frame and its already attached ironing board and clothes hanging storage bar. This compact folding capability permits the different laundry work stations to be folded against the sides of the mobile cart and permits easy storage of the entire assembly.

Generally, the cart frame may be rectangular and include a plurality of laundry bags which are suspended from the mouth of this frame. The frame may be readily constructed or comprised of plastic tubing for easy and inexpensive assembly or construction and light weight mobility.

BRIEF DESCRIPTION OF THE DRAWINGS

Other objects and advantages appear hereinafter in the following description and claims. The accompanying drawings show, for the purpose of exemplification, without limiting the invention or appended claims, certain practical embodiments of the invention wherein:

DETAILED DESCRIPTION OF A PREFERRED EMBODIMENT

Figure 1:
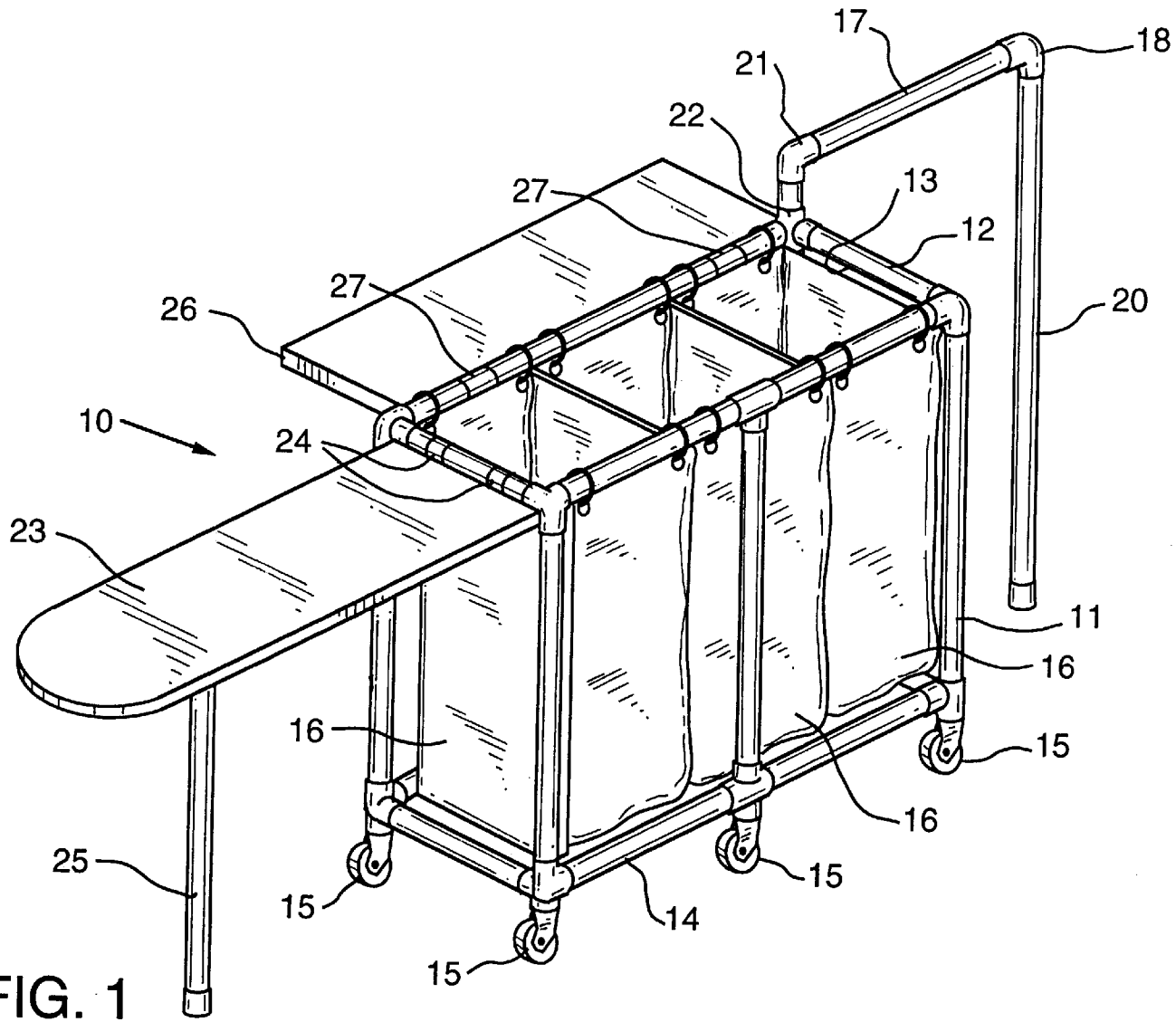
FIG. 1 is an isometric view of one embodiment of the multipurpose laundry cart of the present invention.
Figure 2:
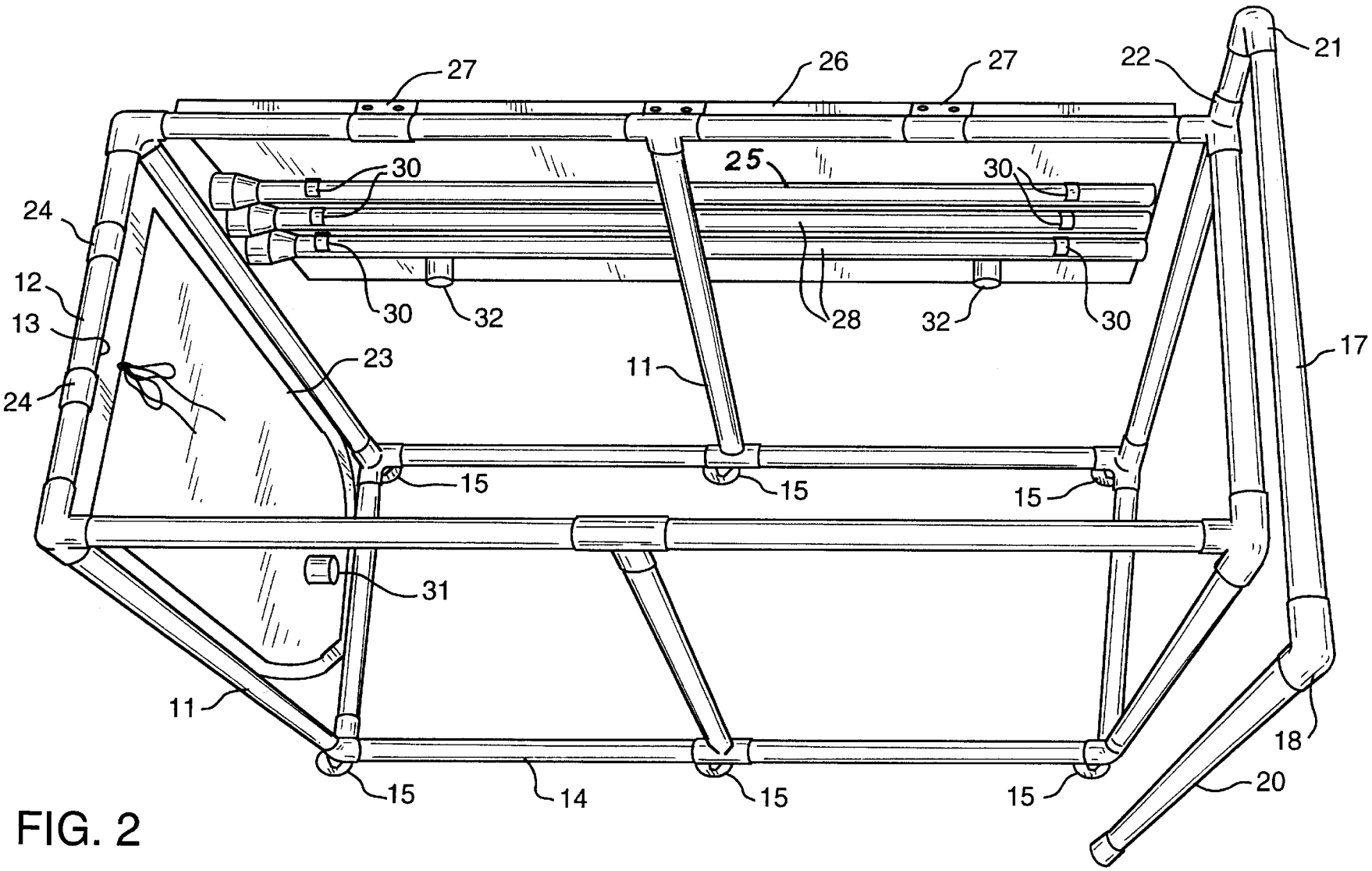
FIG. 2 is a perspective top view of the laundry cart shown in FIG. 1 with the multiple laundry working stations folded against the main frame for mobility therewith without insertion of the laundry bags for clarity of disclosure.

Referring to FIGS. 1 and 2, the multipurpose laundry cart 10 of the present invention is provided with a three dimensional rectangular frame 11 constructed of tubular plastic, such as PVC or the like, which is readily available on the market.

Frame 11 is provided with a top 12 providing an upwardly open mouth 13 and a bottom 14 having caster wheels 15 for mobility of the frame.

Three laundry bags 16 are suspended in the frame from mouth 13.

A horizontal clothes hanging bar 17 is supported at one end 18 by a vertical leg 20 from the floor and is supported at the other end 21 by pivotal connection 22 to frame 11 for pivotally folding the bar 17 in a horizontal plane against the frame 11 for mobility therewith as illustrated in FIG.2. The support arm or bar 11 is shown in its extended position in FIG. 1 so that clothes on hangers may be temporarily suspended from bar 17.

A drop leaf ironing board 23 is hinged to the top 12 of frame 11 by hinges 24 so that it can be hinged downwardly about hinges 24 in a closed position against frame 11 for mobility therewith as illustrated in FIG. 2. Ironing board 23 is supported in its upright usable position by removable support leg 25.

In a similar fashion, laundry cart 10 is also provided with another laundry work station by means of drop leaf laundry folding table 26 which is also hinged to the upper end 12 of frame 11 by hinges 27 for mobility with frame 11 on casters 15.

Laundry folding table 26 can also be hinged downwardly against frame 11 in drop leaf fashion, similar to the ironing board 23, so that all laundry stations may be folded against mobile cart 11 for mobility therewith and easy storage.

Laundry folding table 26 in its upright usable position as a laundry folding station as illustrated in FIG. 1 is supported by two tubular plastic support legs which are not in view.

As is best seen in FIG. 2, the detachable legs 25 and 28 when not in use are stored with clips 30 on the underside of laundry folding table 26.

When these legs are required to be placed in use, they are detached from clips 30 and leg 25 is received over leg mount 31 on the underside of ironing board 23 and the two legs 28 are respectively received on and over the tubular leg mounts 32 provided on the bottom of folding drop leaf laundry folding table 26.

Laundry bags 16 are provided to store laundry as classified as desired by the user.

I claim:

1. A multipurpose laundry cart comprising: a three dimensional frame having a top providing an open mouth and a bottom with caster wheels for mobility of said frame, at least one laundry bag suspended in said frame from said mouth for open top access, a drop leaf ironing board hingedly connected to the top of said frame for mobility therewith, and a horizontal hanging bar supported at one end by a vetical leg and at the other end thereof by a pivot connection to said frame for pivotally folding said bar in a horizontal plane against said frame for mobility therewith.

2. The multipurpose laundry cart of claim 1 including a drop leaf laundry folding table hingedly connected to the top of said frame for mobility therewith.

3. The multipurpose laundry cart of claim 2 wherein said drop leaf ironing board and said drop leaf laundry folding table are supported in a horizontal position by removable legs, and a bottom side of at least one of said ironing board or said folding table includes means for retaining and storing said legs when not in use.

4. The multipurpose laundry cart of claim 2 wherein said frame is rectangular and said at least one laundry bag includes a plurality of laundry bags.

5. The multipurpose laundry cart of claim 4 wherein said frame is comprised of plastic tubing.

* * * * *